US007231735B2

(12) United States Patent
Gelbert

(10) Patent No.: US 7,231,735 B2
(45) Date of Patent: Jun. 19, 2007

(54) LIGHTING CANOPY FOR ADVERTISING SIGN POST

(76) Inventor: Michael S. Gelbert, 2423 E. North La., Phoenix, AZ (US) 85028

( * ) Notice: Subject to any disclaimer, the term of this patent is extended or adjusted under 35 U.S.C. 154(b) by 173 days.

(21) Appl. No.: 11/016,670

(22) Filed: Dec. 17, 2004

(65) Prior Publication Data

US 2006/0133083 A1 Jun. 22, 2006

(51) Int. Cl.
*G09F 13/00* (2006.01)

(52) U.S. Cl. ..... 40/541; 40/607.09; 40/606.19

(58) Field of Classification Search ..... 40/541, 40/542, 564, 572, 574, 607.09, 606.19, 562, 40/568; 362/248, 249; 135/96
See application file for complete search history.

(56) References Cited

U.S. PATENT DOCUMENTS

| | | | | | |
|---|---|---|---|---|---|
| 1,394,853 | A * | 10/1921 | Margileth | 40/563 |
| 1,400,081 | A * | 12/1921 | La Roche | 40/472 |
| 1,409,609 | A * | 3/1922 | Stockle | 135/96 |
| 3,111,782 | A * | 11/1963 | Quigley | 40/617 |
| 4,319,310 | A | 3/1982 | Kingsley | |
| 4,541,675 | A * | 9/1985 | Everett | 312/265.5 |
| 4,910,901 | A | 3/1990 | Boyar | |
| 5,101,329 | A | 3/1992 | Doyle | |
| 5,381,324 | A * | 1/1995 | Hillstrom et al. | 362/362 |
| 5,467,076 | A | 11/1995 | Ruocco et al. | |
| D379,545 | S | 5/1997 | Houghton et al. | |
| 5,988,100 | A | 11/1999 | Schmitt | |
| 6,004,002 | A | 12/1999 | Giannone | |
| 6,263,601 | B1 | 7/2001 | Emert | |
| 6,348,658 | B1 * | 2/2002 | Gutgsell et al. | 174/66 |
| 6,976,329 | B1 * | 12/2005 | Foster | 40/572 |
| 2006/0102217 | A1 * | 5/2006 | Hsiang | 135/92 |
| 2006/0130382 | A1 * | 6/2006 | Howell et al. | 40/607.09 |

* cited by examiner

*Primary Examiner*—Lesley D. Morris
*Assistant Examiner*—Christopher Veraa
(74) *Attorney, Agent, or Firm*—Parsons & Goltry; Michael W. Goltry; Robert A. Parsons

(57) ABSTRACT

A sign assembly includes a fixture capable of being attached to a sign support structure. The sign assembly also includes a canopy which can slideably engage the fixture to provide cover for the sign support structure. The canopy can be foldable and can include lights to illuminate a sign held by the sign support structure. The lights can be provided power through contacts which are engaged when the canopy is attached to the fixture.

31 Claims, 5 Drawing Sheets

FIGURE 3
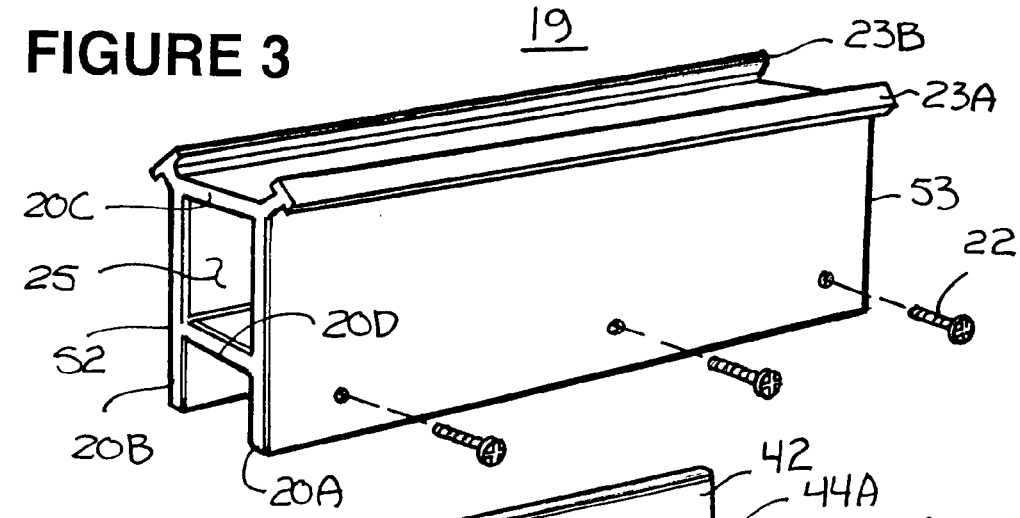
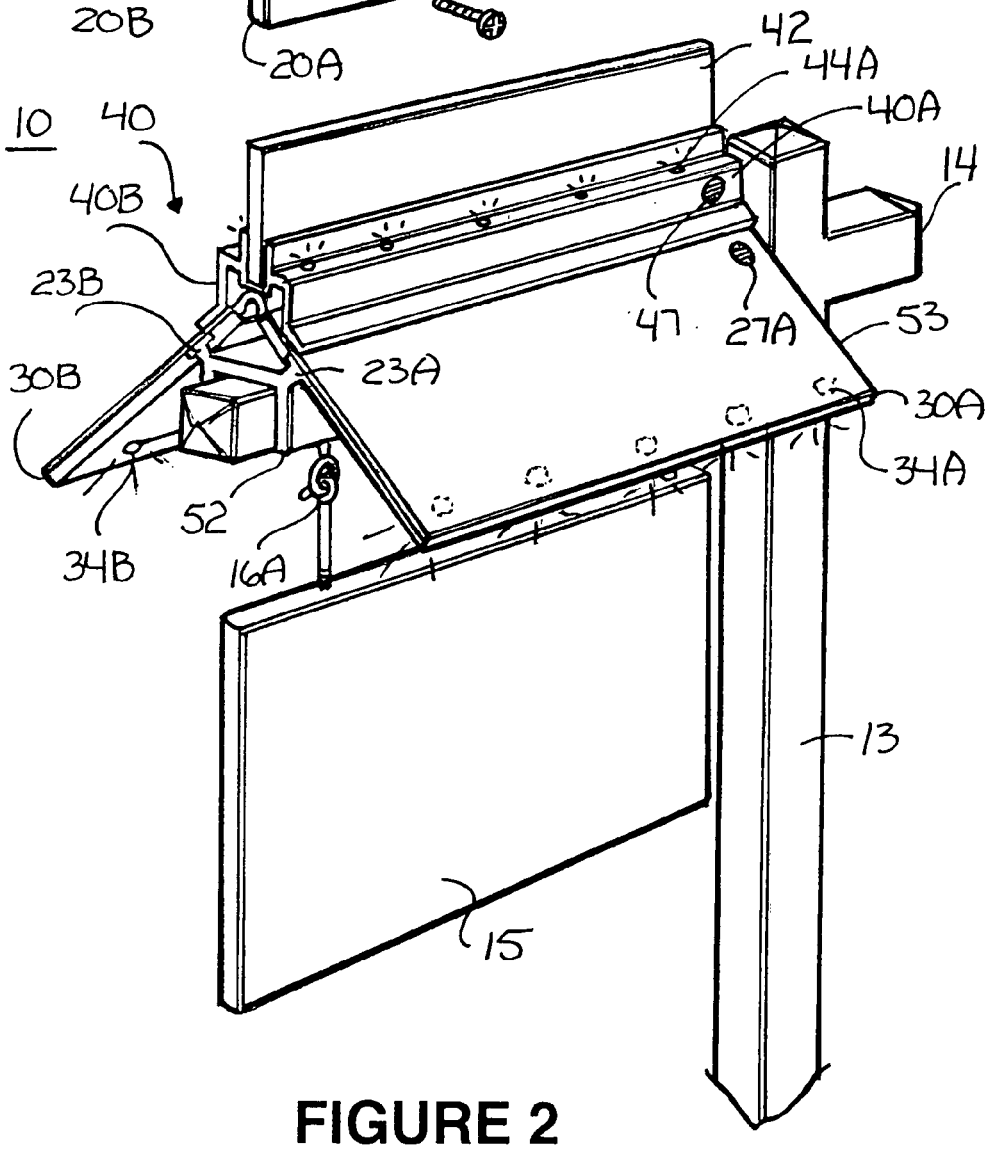
FIGURE 2

FIGURE 5
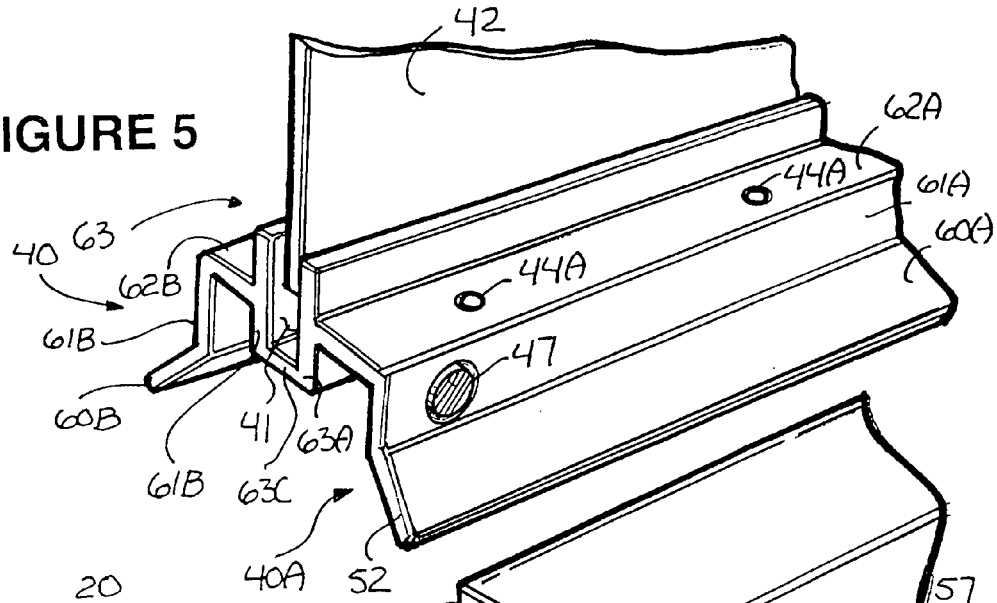
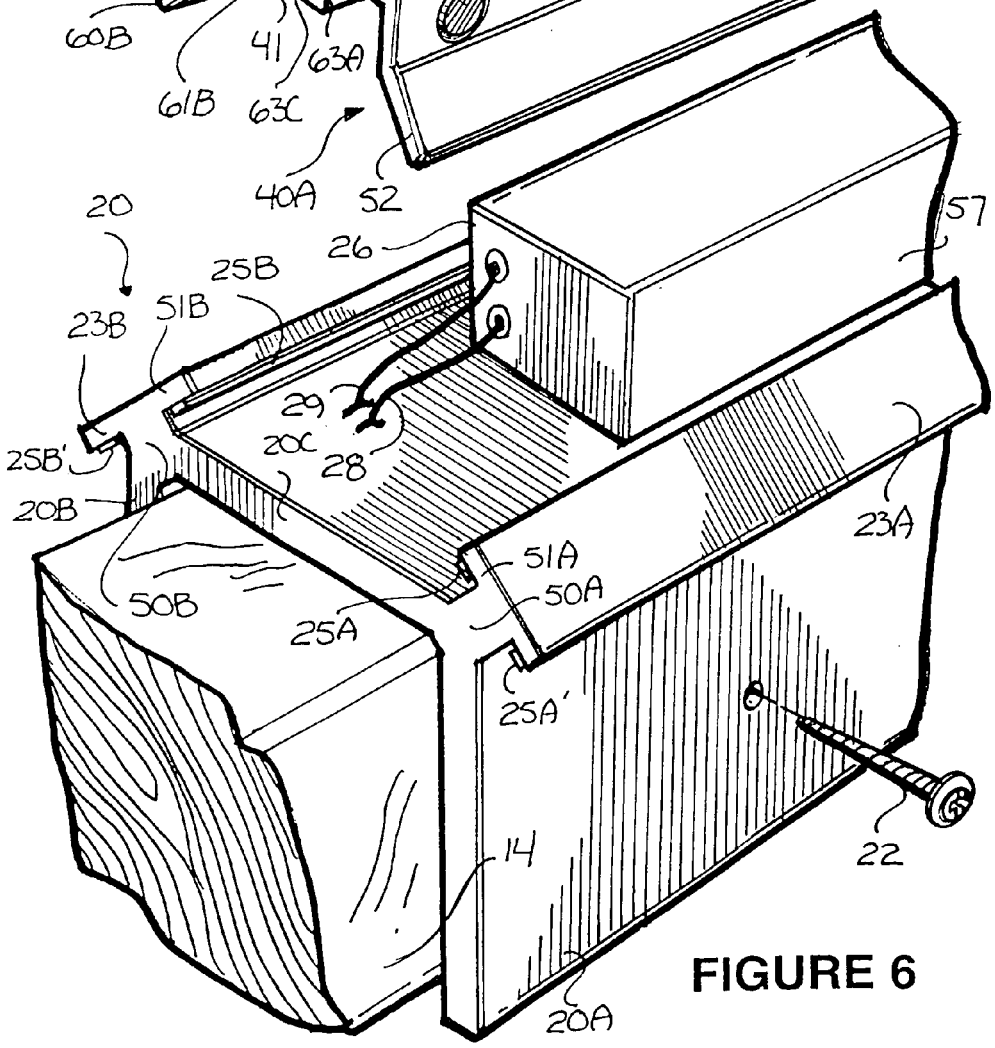
FIGURE 6

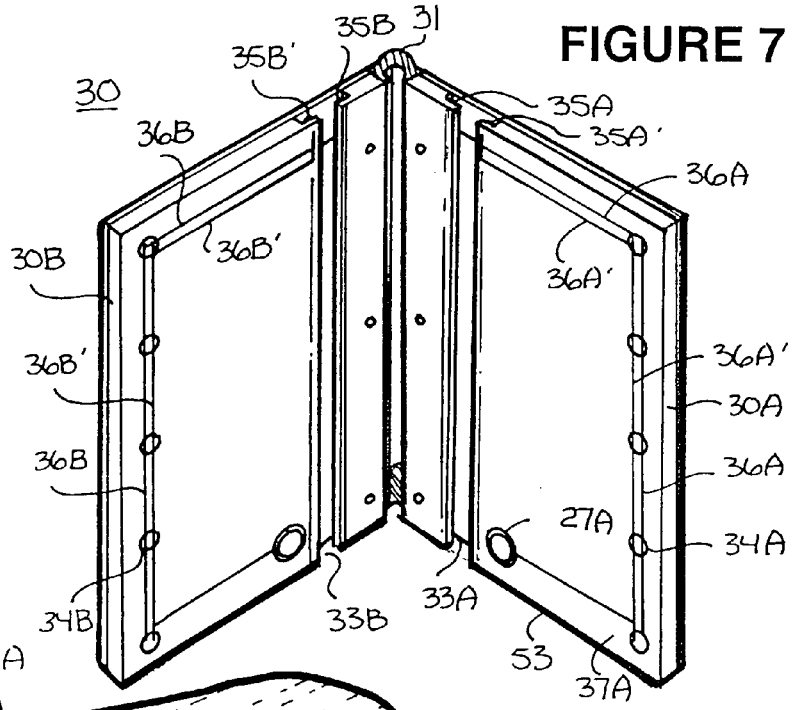
FIGURE 7
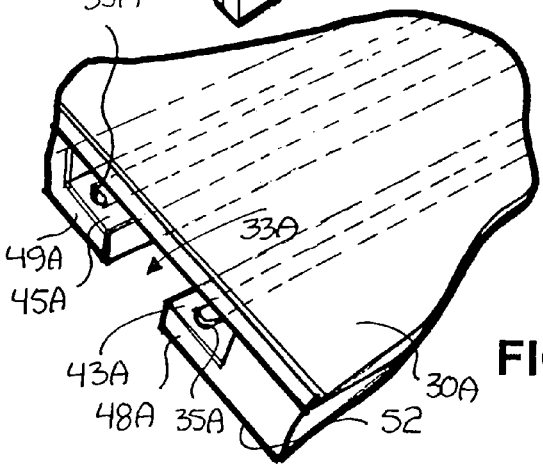
FIGURE 8
FIGURE 9B
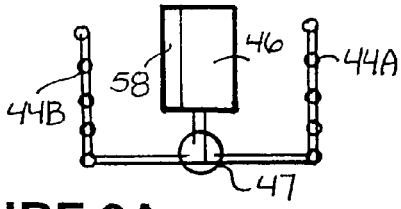
FIGURE 9A
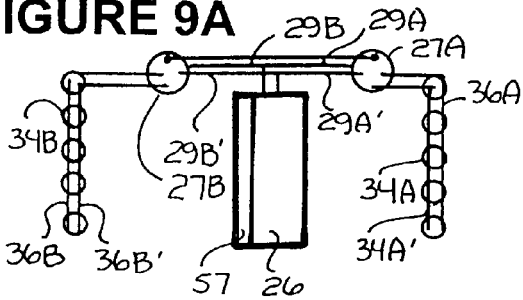

LIGHTING CANOPY FOR ADVERTISING SIGN POST

BACKGROUND OF THE INVENTION

1. Field of the Invention

The present invention generally relates to signage, and, more particularly, lighting and canopy structures for use with signposts.

2. Related Art and Prior Art Statement

Real estate signs are often used to advertise the sale or lease of a particular piece of property. Typical real estate signs include a vertical post with a horizontal cross-arm which holds an advertising panel displaying information about the sale or lease. This information can include contact information such as the name of the person handling the lease or sale of the property. For effective advertising, the sign should be readable from a distance under different lighting conditions and should catch the prospective buyer or leaser's attention.

Some real estate signs include lighting fixtures positioned over the cross-arm to illuminate the sign. However, these lighting fixtures typically include high power lighting systems which can quickly use up the power from a battery. If they are powered by solar cells, then more are needed to provide more power, which increases costs.

These lighting fixtures also tend to be bulky and difficult to attach and remove from the cross-arm. The bulkiness is a problem because real estate signs are often stored and transported from one location to another. The difficulty in attaching and removing the lighting fixture is a problem because this procedure is often performed by one person. Hence, a bulkier lighting fixture requires more storage space to transport and store it and is also more difficult to assemble and disassemble.

BRIEF SUMMARY OF THE INVENTION

The present invention provides a sign assembly with a fixture capable of being attached to a sign support structure and a canopy which engages the fixture to provide cover for the sign support structure. In one embodiment, the canopy can be foldable and can include light source(s) positioned to illuminate a first sign held by the sign support structure. The sign assembly can include a power supply which provides power to the light source(s) through electrical contacts. The electrical contacts can be frictionally engaged when the canopy engages the fixture. In some embodiments, the sign assembly can include a sign holding fixture coupled to the canopy. The sign holding fixture can include a slot for receiving a second sign and light source(s) positioned to illuminate the second sign.

The present invention also provides a sign assembly which includes a fixture capable of being attached to the sign support structure and a foldable canopy capable of being attached to the fixture. The fixture and foldable canopy can be slideably engaged with tongue and groove structure(s). The canopy can include first and second panels hinged together so that the angle between them can be adjusted.

In this embodiment, the foldable canopy can include light source(s) to illuminate a sign held by the sign support structure. One or more light sensors can be coupled to the light source(s) to operate them in response to the amount of light receive by the sensor(s). Electrical contacts can be positioned on the fixture and canopy so that they are electrically engaged when the canopy is attached to the fixture.

The sign assembly can include a power supply which provides a power signal to the electrical contacts. The electrical contacts can include first and second electrical contacts positioned on the fixture and foldable canopy, respectively, so that the first and second electrical contacts are frictionally engaged when the fixture is attached to the foldable canopy.

The present invention further provides a sign assembly with a fixture configured to be coupled to a sign support structure and a canopy coupled to the fixture. The fixture includes a first electrical contact and the canopy includes a second electrical contact. The first and second electrical contacts are engaged when the canopy is coupled to the fixture. The canopy can include first and second panels coupled together with a living hinge. In some embodiments, the canopy is frictionally engaged to the fixture. The canopy can include a first lighting system electrically coupled to the power source for providing light to a first sign included in the sign support structure.

In one embodiment, the sign assembly can include first and second electrical contacts which electrically couple the first power supply and lighting system. The first and second electrical contacts can be coupled together by the frictional engagement between the fixture and canopy. In some embodiments, a sign holding fixture can be coupled to the canopy. The sign holding fixture can include a slot for receiving a second sign and a second lighting system for providing light to the second sign. A second power supply can provide power to the second lighting system or the power can be provided by the first power supply.

The present invention also provides a sign assembly which includes a fixture that can be removably attached to a post. The sign assembly also includes a foldable canopy which slideably engages the fixture and a sign holding fixture coupled to the foldable canopy. The sign holding fixture includes a slot for holding a first sign. In one embodiment, the fixture and canopy are frictionally coupled together with tongue and groove structure(s). The foldable canopy can include first and second panels hinged together.

In some embodiments, first and second lighting systems are positioned on the foldable canopy and sign holding fixture, respectively, to provide light in desired directions. The first and second lighting systems are provided power by separate power supplies. A light sensor is included to turn on or off at least one of the first and second lighting systems in response to the amount of light received by the light sensor.

Additionally, the present invention provides a display apparatus which includes a foldable canopy coupled to a sign support structure. A fixture can be positioned to attach the foldable canopy to the sign support structure. The fixture and the foldable canopy can be slideably engaged together. The foldable canopy can include first light source(s) positioned to illuminate a first sign held by the sign support structure. In some embodiments, the display apparatus can include a sign holding fixture coupled to the foldable canopy. The sign holding fixture can include a slot for receiving a second sign and second light source(s) positioned to illuminate the second sign.

These and other features, aspects, and advantages of the present invention will become better understood with reference to the following drawings, description, and claims.

BRIEF DESCRIPTION OF THE DRAWINGS

Referring to the drawings:

FIG. 2 is a simplified unexploded perspective view of the display apparatus of FIG. 1;

FIG. 3 is a simplified perspective view of one embodiment of a fixture, in accordance with the present invention, which includes a storage housing;

FIG. 5 is a more detailed perspective view of a sign holding fixture included in the display apparatus of FIG. 1;

FIG. 6 is a more detailed perspective view of a fixture included in the display apparatus of FIG. 1;

FIG. 7 is a bottom view of a canopy included in the display apparatus of FIG. 1;

FIG. 8 is a more detailed perspective view of a groove included in the display apparatus of FIG. 1; and FIGS. 9*a* and 9*b* are simplified circuit schematics of the electrical lighting systems included in the canopy and sign holding fixture, respectively, of FIG. 1.

DETAILED DESCRIPTION OF THE INVENTION

Figure 1:
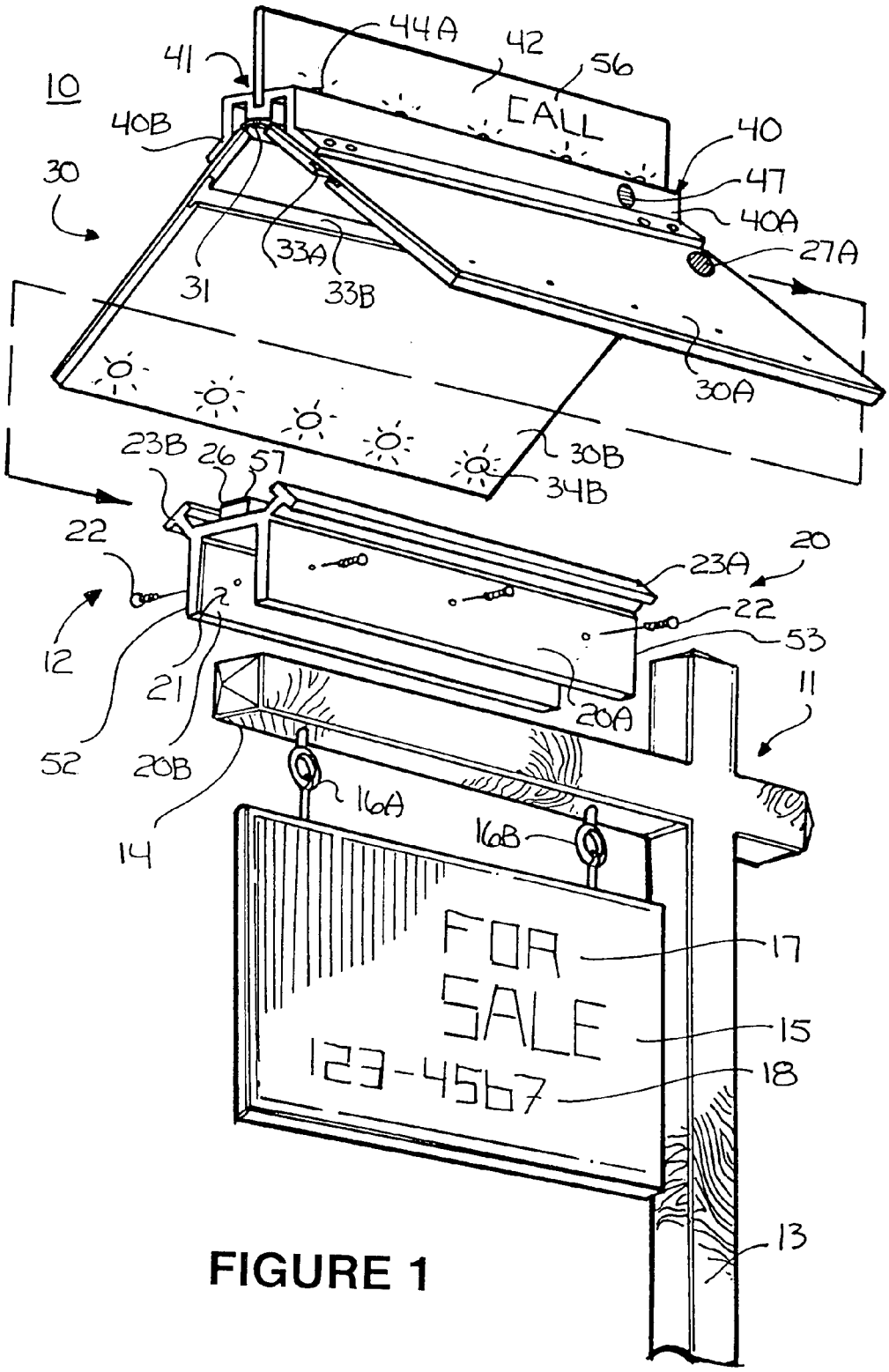
FIG. 1 is a simplified exploded perspective view of a display apparatus in accordance with the present invention.

FIGS. 1 and 2 are simplified perspective views of a display apparatus 10 in accordance with the present invention. FIG. 1 is an exploded perspective view and FIG. 2 is an unexploded perspective view. It should be noted that like reference characters indicate corresponding elements throughout the several views. Apparatus 10 can be used as a sign to convey information to a viewer. For example, it can be used as a real estate sign where it is desired to provide information about the sale or lease of real estate, although other information can be provided. It is typically desired to provide this information so it is viewable day and night and under different lighting conditions.

Display apparatus 10 includes a sign support structure 11 and a sign assembly 12. Sign support structure 11 includes an upstanding post 13 which supports a cross-arm post 14. A lower end (not shown) of post 13 is typically embedded into the ground so that it stands upright. Support structure 11 shown in FIG. 1 is the configuration typically used for real estate displays and is shown for simplicity and ease of discussion. It should be noted, however, that sign support structure 11 can be configured in many different ways.

Cross-arm post 14 supports a sign 15 which depends downwardly therefrom and displays information which is desired to convey to a viewer. The information includes lettering 17 and numbering 18, but it could include other indicia or images such as a picture. Sign 15 is typically held in a position above the ground and at a level where it is easy to view. In this example, sign 15 is coupled to post 14 with hook and loop structures 16*a* and 16*b*, although sign 15 can be coupled to post 14 with other fasteners.

In accordance with one embodiment of the invention, sign assembly 12 includes a fixture 20 which is engageable to a post 14 and a canopy 30 which is engageable to fixture 20. Fixture 20 is attached to cross-arm post 14 with screws 22 although other fasteners could be used. In some embodiments, it is generally desired to attach fixture 20 to post 14 temporarily, so the type of fastener can be chosen to make it easy to separate them. In other embodiments, where it may not be desired to easily detach fixture 20 from post 14, an adhesive or another more permanent fastening method can be used.

In this embodiment, fixture 20 is shaped like an inverted U with opposed walls 20*a* and 20*b* coupled together with a wall 20*c*. Walls 20*a* and 20*b* are spaced apart to form a slot 21 which receives cross-arm post 14. Walls 20*a* and 20*b* are parallel to each other and perpendicular to wall 20*c*. Slot 21 and walls 20*a*, 20*b*, and 20*c* extend between ends 52 and 53 of sign assembly 12 so that slot 21 is shaped to receive post 14. It should be noted, however, that fixture 20 can have other features and/or shapes so that it can be mounted to structure 11 in substantially the same manner as that shown in FIGS. 1 and 2. For example, other shapes for fixture 20 can be provided by curving sides 20*a*, 20*b*, and/or 20*c* if cross-arm 14 has a curved cross-sectional shape instead of square as shown.

In accordance with the invention, canopy 30 is foldable so that it is easily transported to and from various locations in a compact manner. This also makes it easier to store assembly 12 because less storage space is required if canopy 12 is foldable. Here, canopy 30 includes panels 30*a* and 30*b* coupled together with a living hinge 31. Panels 30*a* and 30*b* each have inner edges coupled together by hinge 31 and outer edges which extend away and downward from hinge 31. Panels 30*a* and 30*b* also have inner surfaces 37*a* and 37*b*, respectively, and outer surfaces 38*a* and 38*b*, respectively.

The use of a living hinge here is for illustrative purposes. Accordingly, panels 30*a* and 30*b* can be hinged together with other types of structures so that angle θ between panels 30*a* and 30*b* can be adjusted. Angle θ can be seen better in FIG. 4 which is a simplified front view of display apparatus 10 looking in a direction along cross-arm 14 towards post 13 from end 52 to end 53.

Hinge 31 includes a central flexible portion 31*c* with coupling portions 31*a* and 31*b* attached to respective inner edges of panels 30*a* and 30*b*. Hinge 31 is continuous between ends 52 and 53, although it could be segmented so that the segments cooperate as a single continuous hinge structure. Hinge 31 is flexible so that angle θ between panels 30*a* and 30*b* is adjustable. For example, when it is desired to store and/or transport canopy 30, θ can be made zero so that inner surfaces 37*a* and 37*b* are adjacent to one another. In this way, panels 30*a* and 30*b* can be superimposed when canopy 30 is folded. In another example, the hinge can allow θ to be adjusted to 180° so that panels 30*a* and 30*b* can be made to lie flat. It should be noted, however, that in some embodiments, canopy 30 does not have to be foldable.

Fixture 20 and canopy 30 are formed to be light weight so they can be easily mounted and dismounted from sign support structure 11 and from each other. To make fixture 20 and canopy 30 lightweight, they are formed out of materials which are also light weight so that these components are more easily moved and assembled and disassembled. Suitable materials can include plastic, wood, and ceramics among others. The material should also be able to withstand weathering so that these components are durable and have a long lifetime when positioned outdoors.

To make it easy to engage fixture 20 and canopy 30, they are slideably coupled together with tongue and groove structures or other male and female coupling components. In this way, they are also removably coupled together. Here, fixture 20 includes tongue structures 23*a* and 23*b* which are fixedly attached to it and canopy 30 includes grooves 33*a* and 33*b* which are adapted to receive tongues 23*a* and 23*b*. Tongue 23*a* is positioned along the intersection of walls 20*a* and 20*c* of fixture 20 and tongue 23*b* is positioned along the intersection of walls 20*b* and 20*c*. Tongue 23*a* includes a base portion 50*a* which extends outward and at an angle from the intersection region of walls 20*a* and 20*c*. Tongue 23*a* has a rail portion 51*a* which extends outwardly from and perpendicular to the outermost surface of base portion 50*a* so that tongue 23*a* is T shaped. Rail portion 51*a* has surfaces

73*a* and 75*a* which are positioned on opposite sides of base portion 50*a* and face inwardly towards walls 20*a* and 20*c*, respectively.

Likewise, tongue 23*b* includes a base portion 50*b* which extends outward and at an angle from the intersection region of walls 20*b* and 20*c*. Tongue 23*b* has a rail portion 51*b* which extends outwardly from and perpendicular to the outermost surface of base portion 50*b* so that tongue 23*b* is T shaped. Rail portion 51*b* has surfaces 73*b* and 75*b* which are positioned on opposite sides of base portion 50*b* and face inwardly towards walls 20*b* and 20*c*, respectively. In this embodiment, tongues 23*a* and 23*b* are continuous between ends 52 and 53, although they could be segmented so that the segments cooperate as a single continuous tongue structure.

It should be noted that fixture 20 is formed as a single piece which can be a moldable plastic, for example. However, it can be formed in separate pieces which are then coupled together. For example, walls 20*a*, 20*b*, and 20*c* can be separate plastic pieces which are then attached together using an adhesive to form the U-shaped structure. Also, tongues 23*a* and 23*b* are integrated with respective walls 20*a*, 20*b*, and 20*c* so that they form a single unit. Although, tongues 23*a* and 23*b* can be formed separately then attached to respective walls 20*a*, 20*b*, and 20*c* using an adhesive or other fastening devices.

The groove structures of canopy 30 include grooves 33*a* and 33*b* formed within panels 30*a* and 30*b*, respectively. Groove 33*a* is positioned along inner surface 37*a* of panel 30*a* and groove 33*b* is positioned along inner surface 37*b* of panel 30*b*. Grooves 33*a* and 33*b* are spaced a distance from the inner edge of respective panels 30*a* and 30*b* so that they can be mated with tongues 23*a* and 23*b*, respectively, when canopy 30 is unfolded. Grooves 33*a* and 33*b* extend between ends 52 and 53 of sign assembly 12, although they can be segmented so the segments operate as a continuous groove structure.

Groove 33*a* includes a central opening 54*a* which extends from inner surface 37*a* towards outer surface 38*a*. Groove 33*a* has a slot 55*a* which extends outward from opening 54*a* in opposite directions towards the inner and outer edges of panel 30*a*. Accordingly, slot 55*a* forms fingers 48*a* and 49*a* which both extend inward towards central opening 55*a*. Fingers 48*a* and 49*a* have surfaces 43*a* and 45*a*, respectively, which face slot 55*a* so that surfaces 43*a* and 45*a* are opposed to surface 37*a*.

Similarly, groove 33*b* includes a central opening 54*b* which extends from inner surface 37*b* towards outer surface 38*b*. Groove 33*b* has a slot 55*b* which extends outward from opening 54*b* in opposite directions towards the inner and outer edges of panel 30*b*. Slot 55*b* forms fingers 48*b* and 49*b* which both extend inward towards central opening 55*b*. Fingers 48*b* and 49*b* have surfaces 43*b* and 45*b*, respectively, which face slot 55*b* so that surfaces 43*b* and 45*b* are opposed to surface 37*b*.

In accordance with the invention, tongues 23*a* and 23*b* are shaped to engage corresponding grooves 33*a* and 33*b* of canopy 30. This can be seen in more detail in FIG. 4. When fixture 20 is engaged to canopy 30, surfaces 73*a* and 75*a* of rail 51*a* are adjacent to surfaces 43*a* and 45*a*, respectively, of corresponding fingers 48*a* and 49*a*. Similarly, surfaces 73*b* and 75*b* of rail 51*b* are adjacent to surfaces 43*b* and 45*b*, respectively, of corresponding fingers 48*b* and 49*b*. Hence, grooves 33*a* and 33*b* are adapted to receive corresponding tongues 23*a* and 23*b* so that fixture 20 and canopy 30 can be slideably engaged. In this way, they can be frictionally coupled together and so they can be easily engaged and disengaged.

It should be noted that tongues 23*a*,23*b* and grooves 33*a*,33*b* are positioned on fixture 20 and canopy 30, respectively, for illustrative purposes only and that other configurations are possible. For example, tongues 23*a*,23*b* and grooves 33*a*,33*b* can be positioned on canopy 30 and fixture 20, respectively, in some embodiments. Further, fixture 20 and canopy 30 can also be engaged with fasteners or an adhesive.

In one embodiment, sign assembly 12 includes a sign holding fixture 40 coupled to canopy 30. This can be seen in FIGS. 4 and 5, in which FIG. 5 is a perspective view of sign holding fixture 40. In this example, sign holding fixture 40 includes flanges 40*a* and 40*b* coupled together with a sign holding member 63. Sign holding member 63 is U shaped with opposed walls 63*a* and 63*b* coupled together with a wall 63*c* so that they are parallel to each other and perpendicular to wall 63*c*. Walls 63*a* and 63*b* are spaced apart to form a slot 41 which receives a sign 42. Sign 42 displays lettering 56, but it could also show numbering or other images, such as a picture. It should be noted that in some embodiments, sign holding fixture 40 can be replaced with a mechanical assembly which provides structural strength to sign assembly 12. In these embodiments, the mechanical assembly does not have to include a slot for receiving a sign.

Slot 41 and walls 63*a*, 63*b*, and 63*c* extend between ends 52 and 53 of sign assembly 12 so that slot 41 is shaped to receive sign 42. Slot 41 is oriented so that sign 42 is held in an upright position and the information displayed by sign 42 is conveyed to a viewer. It should be noted, however, that sign holding portion 63 can have other features and/or shapes so that it can hold sign 42 in substantially the same manner as that shown in FIGS. 4 and 5.

Figure 4:
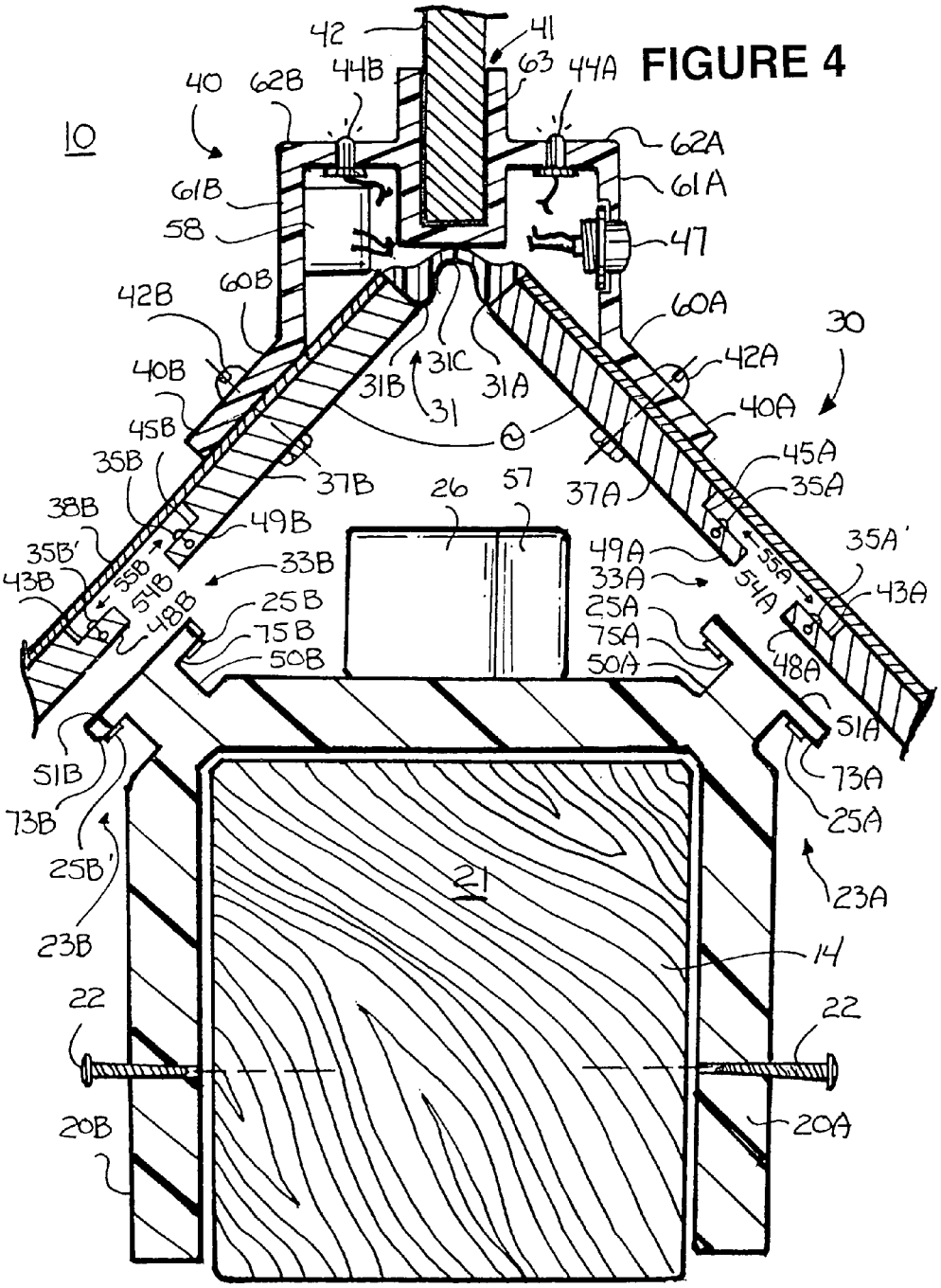
FIG. 4 is a simplified front view of the display apparatus of FIG. 1.

Flange 40*a* includes an outwardly extending member 62*a* with one edge coupled with and perpendicular to wall 63*a*. The opposed edge of member 62*a* is coupled to one edge of a downwardly extending member 61*a*, which extends perpendicular to member 62*a*. A flared member 60*a* is coupled to the opposed edge of member 61*a* and angled in a downward direction so that it can be coupled to panel 30*a* of canopy 30 when canopy 30 is unfolded. Flared member 60*a* is coupled to panel 30*a* with nut and bolt assembly 42*a*, as shown in FIG. 4. However, member 60*a* can be coupled to panel 30*a* with other fastening devices or an adhesive.

Similarly, flange 40*b* includes an outwardly extending member 62*b* with one edge coupled to and perpendicular to wall 63*b*. The opposed edge of member 62*b* is coupled to one edge of a downwardly extending member 61*b*, which extends perpendicular to member 62*b*. A flared member 60*b* is coupled to the opposed edge of member 61*b* and angled in a downward direction so that it can be coupled to panel 30*b* of canopy 30 when canopy 30 is unfolded. Flared member 60*b* is coupled to panel 30*b* with nut and bolt assembly 42*b*, as shown in FIG. 4. However, member 60*b* can be coupled to panel 30*b* with other fastening devices or an adhesive. It should be noted that flanges 40*a* and 40*b* can have other shapes or structural features so they can couple sign holding member 63 and/or provide mechanical strength to canopy 30.

In some embodiments of sign assembly 12, lighting systems are included to illuminate signs 15 and/or 42. The lighting systems for signs 15 and 42 can be separate or they can be electrically coupled together. For example, the lighting systems can have separate power sources and they can also have separate light sensors and/or control circuitry to turn them on and off in response to the ambient light. In other examples, the lighting systems can be electrically coupled to the same power source and they can be turned on and off by the same light sensor and/or control circuitry.

The lighting systems included in sign assembly 12 can be seen in FIG. 4. In this particular embodiment, the lighting systems are separate, as discussed in more detail below. Accordingly, fixture 20 includes a lighting system for providing light in a desired direction and sign holding fixture 40 includes another lighting system for providing light in another desired direction. For the lighting systems included in fixture 20 and fixture 40, the desired directions are towards signs 15 and 42, respectively, so that the corresponding signs are illuminated.

The lighting system for sign 15 includes lights 34*a* and 34*b* coupled to corresponding light sensors 27*a* and 27*b* and supported by panels 30*a* and 30*b*, respectively, as shown in FIGS. 1 and 2. Lights 34*a* and 34*b* are on opposing sides of sign 15 to that they can provide illumination to both sides. They are positioned towards the outer edge of respective panels 30*a* and 30*b* and directed towards corresponding sides of sign 15 to provide sufficient illumination to a desired area of it. The lighting system for sign 42 includes lights 44*a* and 44*b* coupled to light sensor 47 and supported by sign holding fixture 40, as shown in FIGS. 1, 2, and 4. Lights 44*a* and 44*b* are on opposing sides of sign 42 to provide illumination to both sides of it and over a desired area. It should be noted that only one side of signs 15 and/or 42 could be illuminated by their respective lights, but both sides are illuminated in this example for illustrative purposes.

In accordance with the invention, lights 34*a*,34*b* and 44*a*,44*b* include low power light sources, such as light emitting diodes. Light emitting diodes use less power, provide higher light intensities, and have longer lifetimes than incandescent lights. It should be noted, however, that other light sources, such as incandescent or fluorescent lights, can be used in some embodiments. If a light emitting diode is used, it may be desirable to have it emit white light to provide the best illumination of signs 15 and 42, although other colors can be used.

For example, signs 15 and 42 can include phosphorescent or afterglow materials in lettering 17, 56, and/or numbering 18. These materials provide visible light in response to receiving incident light of a shorter wavelength than the visible light. Accordingly, lights 34*a*,34*b* and 44*a*,44*b* can include ultraviolet light emitting diodes or other light sources which emit light at shorter wavelengths then the light provided by the phosphorescent material. Some afterglow effect materials include polycrystalline inorganic zinc sulphide (green afterglow) or alkaline earth sulphides (red or blue afterglow), and can be used in paints or inks and applied to signs 15 and/or 42.

An advantage in this embodiment is that light sources 34*a*,34*b* and 44*a*,44*b* do not need to be operated continuously which decreases the amount of power used. Lights 34*a*,34*b* and 44*a*,44*b* can be operated long enough to cause the afterglow material included in signs 15 and 42 to phosphoresce and then turned off. Lights 34*a*,34*b* and 44*a*, 44*b* can then be turned back on when the phosphoresce decreases below a predetermined intensity. These steps can be repeated as much as desired.

A power supply 26 provides power to light sources 34*a* and 34*b* and a power supply 46 provides power to light sources 44*a* and 44*b*. Light sources 34*a* and 34*b* are operated by control circuitry 57 and light sources 44*a* and 44*b* are operated by control circuitry 58. Power supply 26 and circuitry 57 are carried by fixture 20 and power supply 46 and circuitry 58 are carried by sign support fixture 40. In this particular example, power supply 26 and circuitry 57 are positioned on wall 20*c* of fixture 20 and power supply 46 and circuitry 58 are attached to an inside surface of member 61*b*. However, it should be noted that these elements can be positioned at other locations throughout sign assembly 12.

Power supplies 26 and 46 can include fuel cells and/or batteries, which can be rechargeable. The batteries can be recharged in many different ways, including solar energy or energy provided by an AC adapter. Control circuitry 57 and 58 can include analog and/or digital logic circuitry known in the art to provide signals to control the operation of light sources 34*a*,34*b* and 44*a*,44*b*, respectively. Control circuitry 57 and 58 can be formed as separate modules or they can be integrated with respective power sources 26 and 46.

Power from supplies 26 and 46 can be provided to corresponding lights 24*a*,24*b* and 44*a*,44*b* through wires, conductive interconnects, or other conductors. In this particular example, power source 46 is coupled to light sources 44*a* and 44*b* with wires which are housed within sign holding fixture 40 in a conventional manner. Similarly, power source 26 is coupled to light sources 34*a* and 34*b* with a combination of wires and interconnects. In particular, opposite polarity terminals of power supply 26 are coupled to wires 28 and 29. Here, wire 28 is coupled to a positive terminal of power source 26 and wire 29 is coupled to a negative terminal. This can be seen in FIG. 6 which is a more detailed perspective view of end 52 showing fixture 20.

Wire 28 is coupled to interconnects 25*a* and 25*b* and wire 29 is coupled to interconnects 25*a*' and 25*b*'. In accordance with the invention, interconnects 25*a* and 25*a*' are integrated with tongue 23*a* and interconnects 25*b* and 25*b*' are integrated with tongue 23*b*. In this particular embodiment, interconnects 25*a* and 25*a*' are positioned on opposite sides of tongue 23*a* on surfaces 75*a* and 73*a*, respectively. Similarly, interconnects 25*b* and 25*b*' are positioned on opposite sides of tongue 23*b* on surfaces 75*b* and 73*b*, respectively. Accordingly, wires 28 and 29 provide respective interconnects 25*a*,25*b* and 25*a*',25*b*' with opposite polarity signals from power source 26.

In accordance with the invention, interconnects 35*a* and 35*a*' are integrated with groove 33*a*. Interconnects 35*a* and 35*a*' are positioned on opposite sides of groove 33*a* on surfaces 45*a* and 43*a*, respectively. Similarly, interconnects 35*b* and 35*b*' are integrated with groove 33*b*. Interconnects 35*b* and 35*b*' are positioned on opposite sides of groove 33*b* and on surfaces 45*b* and 43*b*, respectively. The positioning of interconnects 35*a*,35*a*' and 35*b*,35*b*' can be seen in FIG. 8 which is a more detailed perspective view of groove 33*a*.

It should be noted that the interconnects can be positioned differently than shown in FIG. 8. However, in accordance with the invention, the positioning of interconnects 25*a*, 25*a*', 25*b*, and 25*b*' is chosen so that they are coupled to corresponding interconnects 35*a*, 35*a*', 35*b*, and 35*b*' when fixture 20 and canopy 30 are engaged. In this way, power supply 26 provides respective interconnects 35*a*,35*b* and 35*a*',35*b*' with opposite polarity signals.

Interconnects 35*a* and 35*a*' are coupled to light sources 34*a* through respective interconnects 36*a* and 36*a*'. Further, interconnects 35*b* and 35*b*' are coupled to light sources 34*b* through respective interconnects 36*b* and 36*b*'. This is better shown in FIG. 7 which is a simplified bottom view of canopy 30. In FIG. 7, interconnects 36*a*,36*a*' and 36*b*,36*b*', as well as lights 34*a* and 34*b*, are carried by respective panels 30*a* and 30*b*. Here, interconnects 36*a*,36*a*' and 36*b*,36*b*' are embedded in respective panels 30*a* and 30*b*. However, they can also be positioned on respective bottom surfaces 37*a* and 37*b*.

It should be noted that interconnects 25*a*,25*a*' and 25*b*, 25*b*' are positioned in respective tongues 23*a* and 23*b* and interconnects 35*a*,35*a*' and 35*b*,35*b*' are positioned in respective grooves 33*a* and 33*b* in this example for illustrated purposes only. In other examples, interconnects 25*a*, 25*a*' and 25*b*,25*b*' and interconnects 35*a*,35*a*' and 35*b*,35*b*' can be otherwise positioned so that they are electrically coupled together when canopy 30 engages fixture 20. The interconnects are shown as extending between ends 52 and 53 for illustrative purposes only. In some embodiments, the interconnects can be segmented so that they can communicate more signals between fixture 20 and canopy 30. These signals can include control signals from control circuitry 57 communicated to light sensor 27*a* and/or 27*b*. The interconnects can include metal strips of materials well known to those skilled in the art, such as aluminum (Al) and copper (Cu).

A simplified circuit diagram of the electrical connections between power supply 26, control circuitry 57, light sources 34*a* and 34*b*, and light sensors 27*a* and 27*b* is shown in FIG. 9*a*. A simplified circuit diagram of the electrical connections between power supply 46, control circuitry 58, light sources 44*a* and 44*b*, and light sensors 47 is shown in FIG. 9*b*. Light sources 34*a* and 34*b* are coupled to power supply 26 through light sensors 27*a* and 27*b*, respectively, to turn them on or off in response to the amount of ambient light received by them. If sign 15 includes phosphorescent material, then control circuitry 57 can be coupled to power supply 26 to turn lights 34*a*,34*b* on for a desired amount of time to make the phosphorescent material phosphoresce. Control circuitry 57 can then turn lights 34*a*,34*b* off and the steps can be repeated. Control circuitry 57 can be configured to turn lights off 34*a*,34*b* gradually, in which when turned off lights 34*a*,34*b* will dim gradually over a predetermined period of time, such as 2–5 seconds, until they are completely turned off.

Similarly, light sensor 47 is coupled to light sources 44*a* and 44*b* to turn them on or off in response to the amount of light received by it. Hence, light sensors 27*a*, 27*b*, and 47 can operate to turn on their corresponding light sources when it is too dark to see signs 15 and 42 easily. Conversely, light sensors 27*a*, 27*b*, and 47 can operate to turn off their corresponding light sources when it is bright enough to clearly see signs 15 and 42. Control circuitry 58 can operate in a manner similar to circuitry 57. It should be noted that manual switches or timers can be used instead of light sensors 27*a*, 27*b*, and 47 in some embodiments.

Fixture 20 can be configured in many different ways. Another example is shown in FIG. 3 which is a perspective view of a fixture 19. In this embodiment, fixture 19 includes walls 20*a* and 20*b* coupled to wall 20*c* so that they are parallel to each other and perpendicular to wall 20*c*. An intermediate wall 20*d* is positioned parallel to and spaced apart from wall 20*c*. Wall 20*d* is coupled between walls 20*a* and 20*b* so that a storage housing 25 is formed. Walls 20*a*–20*d* extend between ends 52 and 53. Housing 25 is used for holding items, such as business cards with contact information or fliers with more information about the property advertised by display apparatus 10. However, housing 25 can be used to hold other items.

The present invention is described above with reference to preferred embodiments. However, those skilled in the art will recognize that changes and modifications may be made in the described embodiments without departing from the nature and scope of the present invention. Various further changes and modifications will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A sign assembly comprising:

a fixture capable of being attached to a sign support structure;

a foldable canopy capable of being attached to the fixture; and electrical interconnects positioned on the fixture and foldable canopy, the electrical interconnects being electrically engaged when the canopy is attached to the fixture.

2. The assembly of claim 1 further including at least one light source attached to the foldable canopy to illuminate a sign held by the sign support structure.

3. The assembly of claim 2 further including light sensitive circuitry which operates the at least one light source in response to the amount of light received by the circuitry.

4. The assembly of claim 2 further including a power supply positioned proximate to the fixture, the power supply providing power to the light sources(s) through the electrical interconnects.

5. The assembly of claim 1 wherein the canopy includes first and second panels hinged together so that an angle between the first and second panels is adjustable.

6. The assembly of claim 1 wherein the fixture and foldable canopy are slideably engaged with at least one tongue and groove structure.

7. A sign assembly comprising:

a fixture configured to be coupled to a sign support structure, the fixture including a first electrical interconnect; and a canopy coupled to the fixture, the canopy including a second electrical interconnect which electrically engages the first electrical interconnect when the canopy is coupled to the fixture.

8. The assembly of claim 7 wherein the canopy includes first and second panels coupled together with a living hinge.

9. The assembly of claim 7 wherein the canopy is frictionally engaged to the fixture.

10. The assembly of claim 9 further including a power source carried by the fixture and coupled to the first electrical interconnect.

11. The assembly of claim 10 further including a first lighting system coupled to the second electrical interconnect.

12. The assembly of claim 7 further including a sign holding fixture coupled to the canopy, the sign holding fixture including a slot receiving a sign.

13. The assembly of claim 12 wherein the sign holding fixture includes a lighting system for providing light to the sign.

14. The assembly of claim 13 further including a power supply which provides power to the lighting system.

15. The assembly of claim 7 wherein the fixture includes a storage housing for holding items.

16. A sign assembly comprising:

a fixture removably attached to a post, the fixture including a first electrical interconnect;

a foldable canopy which slideably engages the fixture, the foldable canopy including a second electrical interconnect which engages the first electrical interconnect when the foldable canopy and fixture are engaged; and a lighting system carried by the foldable canopy, the lighting system being electrically coupled to the second electrical interconnect.

17. The assembly of claim 16 wherein the fixture and canopy are frictionally coupled together with at least one tongue and groove structure so that they can be separated.

18. The assembly of claim 16 wherein the foldable canopy includes first and second panels hinged together.

19. The assembly of claim 16 wherein the lighting system is positioned on the canopy to provide light in a first desired direction.

20. The assembly of claim 16 further including a sign holding fixture coupled to the foldable canopy, the sign holding fixture including a slot for holding a first sign.

21. The assembly of claim 20 wherein the sign holding fixture further includes a second lighting system positioned to provide light in a second desired direction.

22. The assembly of claim 21 further including separate power supplies which provide power to respective first and second lighting systems.

23. The assembly of claim 21 further including a light sensor which turns on or off at least one of the first and second lighting systems in response to the amount of light received by the light sensor.

24. The assembly of claim 16 further including a sign holding fixture coupled to the foldable canopy, the sign holding fixture providing mechanical support to the foldable canopy.

25. A display apparatus comprising:

a fixture removably attached to a post, the fixture including a first electrical interconnect; and a foldable canopy coupled to the sign support structure, the foldable canopy including a second electrical interconnect coupled to at least one light source positioned to illuminate a first sign held by the post, the first and second electrical interconnects being engaged when the foldable canopy is coupled to the fixture.

26. The apparatus of claim 25 further including a sign holding fixture coupled to the foldable canopy, the sign holding fixture including a slot for receiving a second sign.

27. The apparatus of claim 26 wherein the sign holding fixture includes at least one second light source positioned to illuminate the second sign.

28. The apparatus of claim 25 wherein the fixture and the foldable canopy are slideably engaged together so that they can be easily engaged and disengaged.

29. The assembly of claim 25 wherein the foldable canopy includes panels hinged together so that the angle between them is adjustable.

30. The assembly of claim 26 wherein at least one of the first and second signs includes a phosphorescent material.

31. The assembly of claim 25 further including a mechanical assembly coupled to the foldable canopy, the mechanical assembly providing mechanical support to the foldable canopy.

* * * * *